US006875079B2

(12) United States Patent
Kegeler

(10) Patent No.: US 6,875,079 B2
(45) Date of Patent: Apr. 5, 2005

(54) METHODS OF WORKING, ESPECIALLY POLISHING, INHOMOGENEOUS MATERIALS

(75) Inventor: Joerg Kegeler, Schleusingen (DE)

(73) Assignee: Schott Glas, Mainz (DE)

( * ) Notice: Subject to any disclaimer, the term of this patent is extended or adjusted under 35 U.S.C. 154(b) by 0 days.

(21) Appl. No.: 10/283,955

(22) Filed: Oct. 30, 2002

(65) Prior Publication Data

US 2003/0087591 A1 May 8, 2003

(30) Foreign Application Priority Data

Nov. 2, 2001 (DE) ..... 101 54 050

(51) Int. Cl.[7] ..... B24B 1/00

(52) U.S. Cl. ..... 451/7; 451/53; 451/547; 451/461

(58) Field of Search ..... 451/7, 53, 547, 451/461; 501/7; 219/121.69

(56) References Cited

U.S. PATENT DOCUMENTS 5,364,655 A 11/1994 Nakamura et al.
5,508,235 A * 4/1996 Marker ..... 501/7
5,742,026 A * 4/1998 Dickinson et al. ..... 219/121.69
5,842,909 A * 12/1998 Sandhu et al. ..... 451/7
5,868,953 A 2/1999 Maekawa
5,873,769 A * 2/1999 Chiou et al. ..... 451/7
6,077,151 A * 6/2000 Black et al. ..... 451/53
6,257,955 B1 * 7/2001 Springer et al. ..... 451/7
6,315,635 B1 * 11/2001 Lin ..... 451/7
6,458,018 B1 * 10/2002 Goers et al. ..... 451/41

FOREIGN PATENT DOCUMENTS

DE 696 01 697 T2 7/1999
DE 695 21 911 T2 11/2001
EP 0 934 801 A2 8/1999

* cited by examiner

*Primary Examiner*—George Nguyen
(74) *Attorney, Agent, or Firm*—Michael J. Striker

(57) ABSTRACT

An inhomogeneous glass ceramic material having a ceramic phase and a glass phase is polished by a method that reduces surface roughness at a preselected temperature to values less than 2 Å. The method includes polishing the surface of the glass ceramic material at a predetermined working temperature with a polishing wheel and/or a suspension and selecting the predetermined working temperature so that differing erosion of the glass phase and the ceramic phase is compensated because of the different thermal expansion coefficients when the glass ceramic material is at the preselected temperature. In the case of the glass ceramic material the working temperature generally should be below the preselected temperature in order to minimize surface roughness.

10 Claims, 1 Drawing Sheet

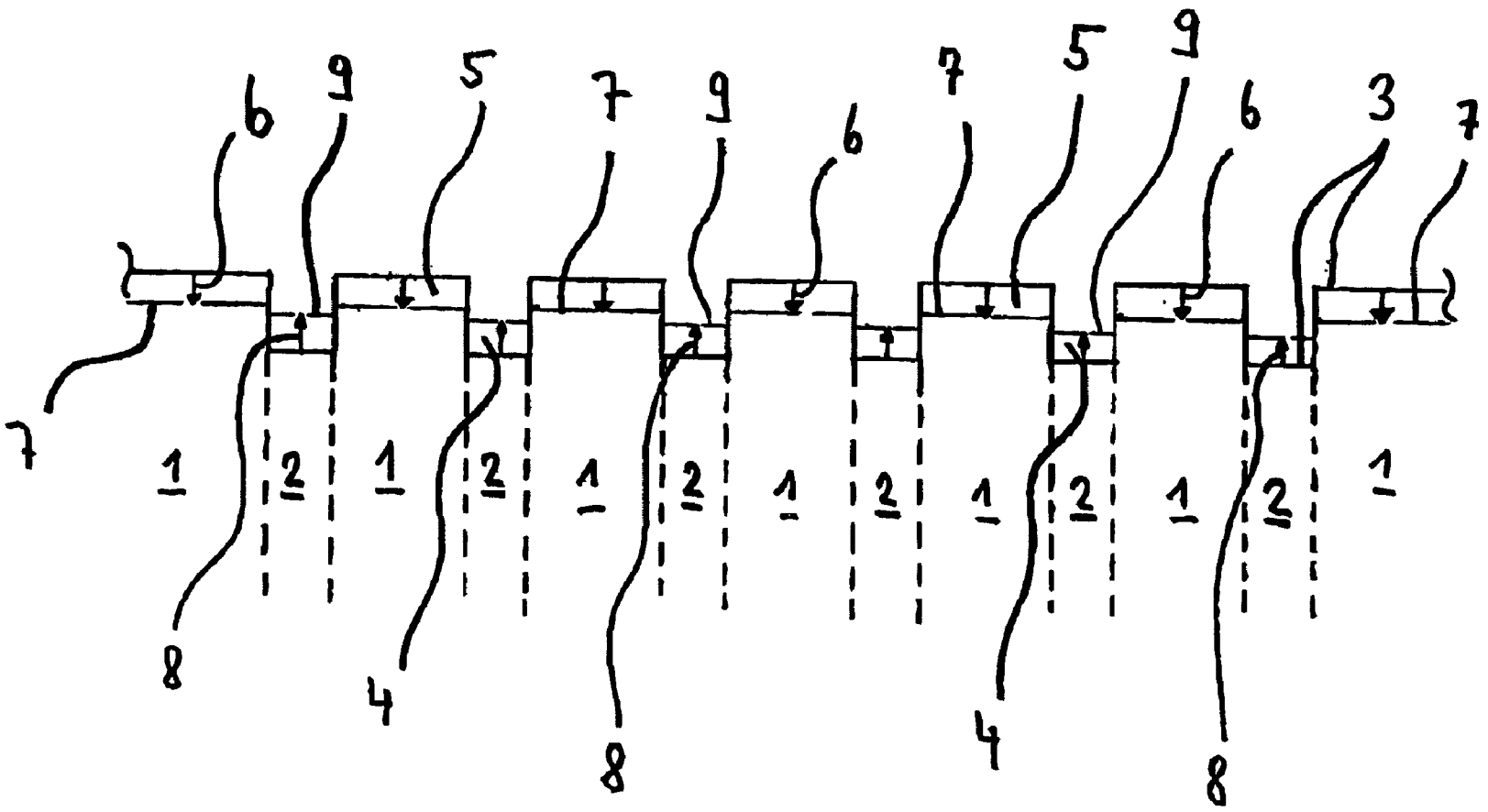
7
3
6
9
5
7
6
9
7
5
9
6
1
2
8
4
1
2
8
4
1
2
8
1

METHODS OF WORKING, ESPECIALLY POLISHING, INHOMOGENEOUS MATERIALS

BACKGROUND OF THE INVENTION

The present invention relates to methods of working, especially of polishing, surfaces of materials composed of at least two components or ingredients.

A typical example of a material composed of two different components is the glass ceramic material, Zerodur®, which has a crystalline phase with a negative thermal expansion coefficient and a glass phase with a positive thermal expansion coefficient. Both phases have different erosion properties.

In the known working method effects described in the following occur during and/or after the working of the surface. First, the surface is polished at a definite working temperature until a minimum polish roughness is reached during the polishing. The polish roughness results predominantly from the different erosion properties of both components. Since the application temperature of the material usually varies from the working temperature, the surface roughness is increased in relation to the polish roughness because of the differing thermal expansion coefficients because of the differing thermal expansion properties of both components, so that the quality of the surface of the material no longer corresponds to the required specification.

For example, the material used for making wafers must have a surface roughness of less than 2 Å. It has not been possible to achieve this currently.

SUMMARY OF THE INVENTION

Consequently it is an object of the present invention to provide a method of working, especially polishing, a surface of a material composed of at least two components, so as to improve its surface quality at its application or usage temperature.

It is another object of the present invention to provide a method for working, particularly polishing, a surface of a glass-ceramic material to attain a surface roughness of less than 2 Å.

According to the invention the method of polishing a surface of a material composed of at least two components, each of which is present in the surface to be polished, includes polishing the surface of the material with at least one of a polishing wheel and a suspension at a predetermined working temperature and selecting the predetermined working temperature so that erosion of the at least two different components is compensated because of different thermal expansion properties of the at least two different components and so that a surface roughness of this surface is minimized at an application temperature of the material.

In this method the working temperature is adjusted to be above or below the application temperature so that comparatively depressed regions in the component with the higher erosion rate at the application temperature rise according to their thermal expansion coefficient and, at the same time, comparatively raised regions in the other component with the lower erosion rate shrink back or at least rise to a lesser extent. This behavior is based on knowledge of the application temperature after the manufacturing process and on the respective erosion properties of the components. An improved planarity or evenness of the material surface at the application temperature is attained by this procedure using knowledge of the later application temperature considering the material-specific properties, namely the erosion properties and thermal expansion properties.

In other materials, it is also possible that two different components have the same erosion properties but different thermal expansion coefficients. The method according to the invention with the predetermined processing temperature and the known application temperature attains the object of the invention when the processing or working temperature is selected to be the application temperature.

During the working, when the erosion properties of the components are the same, an optimum surface roughness results. This leads to a deterioration of the surface roughness with other application temperatures than the working temperature, because of the different thermal expansion coefficients and the different expansion rates connected with them.

In a special embodiment the temperature of the polishing disk or wheel, and better also that of the suspension, is measured.

With the help of this procedure the working temperature, which can be adjusted by means of the suspension and/or the polishing wheel in an advantageous embodiment, is controlled and balanced or compensated as needed.

BRIEF DESCRIPTION OF THE DRAWING

The objects, features and advantages of the invention will now be described in more detail with the aid of the following description of the preferred embodiment, with reference to the sole accompanying FIGURE, which is a diagrammatic cross-sectional view through an example of a surface of an inhomogeneous material that is to be worked.

DETAILED DESCRIPTION OF THE INVENTION

The sole FIGURE diagrammatically shows a surface 3 of a glass ceramic material to be worked, i.e. polished, during the working of the surface at a working temperature, but also after the working of the surface at the already previously known application temperature. In the embodiment shown in the FIGURE the working temperature is less than the application temperature. Furthermore the glass phase 2 has greater erosion and a positive thermal expansion coefficient in contrast to the ceramic phase 1. The ceramic phase has a negative thermal expansion coefficient.

During the working, i.e. polishing, comparatively depressed regions 4 form in the glass phase 2, which result from greater erosion of the glass than the ceramic material during the polishing process. At the same time raised regions 5 are produced in the ceramic phase 1.

After the working or polishing the temperature increases to the final application temperature, so that the glass phase 2 with a positive thermal expansion coefficient expands for a certain expansion distance 8 until at final glass surface level 9. The ceramic phase 1, which has a negative thermal expansion coefficient, shrinks or draws pack for a certain shrinkage distance 6 until at the final ceramic surface level 7.

The working or polishing produces the resulting surface levels 7,9 at the application temperature, which comprises a surface level 7 of the ceramic phase at the application temperature and a surface level 9 of the glass phase at the application temperature. The resulting material surface is of improved smoothness.

The disclosure in German Patent Application 101 54 050.7 of Nov. 2, 2001 is incorporated here by reference. This German Patent Application describes the invention described hereinabove and claimed in the claims appended hereinbelow and provides the basis for a claim of priority for the instant invention under 35 U.S.C. 119.

While the invention has been illustrated and described as embodied in a method of working, especially polishing, inhomogeneous materials, it is not intended to be limited to the details shown, since various modifications and changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and is set forth in the following appended claims.

I claim:

1. A method of polishing a surface of an inhomogeneous material so as to reduce surface roughness of said surface at a preselected temperature, said inhomogeneous material comprising two different components present on said surface to be polished, said two different components having different erosion rates and different thermal expansion coefficients, wherein said method comprises the steps of:

a) selecting a working temperature at which said surface of said inhomogeneous material is polished so that differing erosion of said two different components is compensated so that surface roughness is thereby reduced because of differing thermal expansion of said different components due to said different thermal expansion coefficients when said inhomogeneous material is at said preselected temperature; and b) polishing said surface of said inhomogeneous material at said working temperature;

whereby said surface roughness of said surface is minimized when said inhomogeneous material at said preselected temperature.

2. A method of polishing a surface of an inhomogeneous material so as to reduce surface roughness of said surface at a preselected temperature, said inhomogeneous material comprising two different components present on said surface to be polished, said two different components having different erosion rates and different thermal expansion coefficients, wherein said method comprises the steps of:

a selecting a working temperature at which said surface of said inhomogeneous material is polished so that differing erosion of said two different components is compensated because of said different thermal expansion coefficients when said inhomogeneous material is at said preselected temperature; and b) polishing said surface of said inhomogeneous material at said working temperature; wherein said inhomogeneous material is a glass ceramic material comprising a ceramic phase with negative thermal expansion coefficient and a glass phase with a positive thermal expansion coefficient, said glass phase has a greater erosion rate than that of said ceramic phase and said preselected temperature is greater than said working temperature;

whereby said surface roughness of said surface is minimized when said inhomogeneous material at said preselected temperature.

3. The method as defined in claim 2, wherein said surface roughness is less than 2 Å.

4. The method as defined in claim 1 or 2, wherein said polishing is performed with a polishing wheel, and further comprising adjusting a temperature of said polishing wheel, so as to perform said polishing of said surface at said working temperature.

5. The method as defined in claim 1 or 2, wherein said polishing is performed with a suspension, and further comprising adjusting a temperature of said suspension, so as to perform said polishing of said surface at said working temperature.

6. A method of polishing a surface of an inhomogeneous material so as to reduce surface roughness of said surface at a preselected temperature, said inhomogeneous material comprising two different components present on said surface to be polished, said two different components having different erosion rates and different thermal expansion coefficients, wherein said method comprises the steps of:

a) polishing said surface of said inhomogeneous material at a predetermined working temperature with at least one of a polishing wheel and a suspension; and b) selecting said predetermined working temperature so that differing erosion of said two different components is compensated so that said surface roughness is thereby reduced because of differing thermal expansion of said different components due to said different thermal expansion coefficients of said two different components when said inhomogeneous material is at said preselected temperature;

whereby said surface roughness of said surface is minimized when said inhomogeneous material is at said preselected temperature.

7. A method of polishing a surface of an inhomogeneous material so as to reduce surface roughness of said surface at a preselected temperature, said inhomogeneous material comprising two different components present on said surface to be polished, said two different components having different erosion rates and different thermal expansion coefficients wherein said method comprises the steps of:

a) a polishing said surface of said inhomogeneous material at a predetermined working temperature with at least one of a polishing wheel and a suspension; and b) selecting said predetermined working temperature so that differing erosion of said two different components is compensated because of said different thermal expansion coefficients of said two different components when said inhomogeneous material is at said preselected temperature; wherein said inhomogeneous material is a glass ceramic material comprising a ceramic phase with a negative thermal expansion coefficient and a glass phase with a positive thermal expansion coefficient, said glass phase has a greater erosion rate than that of said ceramic phase and said preselected temperature is greater than said working temperature;

whereby said surface roughness of said surface is minimized when said inhomogeneous material is at said preselected temperature.

8. The method as defined in claim 7, wherein said surface roughness is less than 2 Å.

9. The method as defined in claim 6 or 7, wherein said polishing is performed with said polishing wheel, and further comprising adjusting a temperature of said polishing wheel, so as to perform said polishing of said surface at said predetermined working temperature.

10. The method as defined in claim 6 or 7, wherein said polishing is performed with said suspension, and further comprising adjusting a temperature of said suspension, so as to perform said polishing of said surface at said predetermined working temperature.

* * * * *